US009909300B2

(12) United States Patent
Miller

(10) Patent No.: US 9,909,300 B2
(45) Date of Patent: Mar. 6, 2018

(54) TRUSS CLAMP ASSEMBLIES

(71) Applicant: Toyota Motor Engineering & Manufacturing North America, Inc., Erlanger, KY (US)

(72) Inventor: Chris Miller, Newburgh, IN (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 0 days.

(21) Appl. No.: 15/071,671

(22) Filed: Mar. 16, 2016

(65) Prior Publication Data

US 2017/0268220 A1 Sep. 21, 2017

(51) Int. Cl.

| | |
|---|---|
| ***E04B 1/58*** | (2006.01) |
| ***E04B 1/41*** | (2006.01) |
| *E04B 1/38* | (2006.01) |

(52) U.S. Cl.

CPC ..... *E04B 1/5831* (2013.01); *E04B 1/40* (2013.01); *E04B 2001/405* (2013.01); *E04B 2001/5875* (2013.01); *E04B 2001/5887* (2013.01)

(58) Field of Classification Search

CPC ..... E04B 1/5831; E04B 2001/5875; E04B 2001/5887; E04B 1/5812

USPC ..... 52/699, 701

See application file for complete search history.

(56) References Cited

U.S. PATENT DOCUMENTS 1,976,595 A * 10/1934 Asleson ..... E04G 17/18 24/569
6,848,221 B1 2/2005 Hartz
6,883,277 B2 * 4/2005 Wiechecki ..... E04B 2/7427 52/238.1
7,445,192 B2 * 11/2008 Gridley ..... E04B 1/4157 249/207
8,336,267 B2 * 12/2012 Montague ..... E04B 1/24 52/295
9,366,022 B2 * 6/2016 Frey ..... E04B 1/5831
2013/0223958 A1 8/2013 Cummings (Continued)

FOREIGN PATENT DOCUMENTS

| | | | | |
|---|---|---|---|---|
| DE | 889515 C * | 9/1953 | ..... | E04B 1/5812 |
| GB | 2115476 A | 9/1983 | | |
| WO | WO2014009702 A1 | 1/2014 | | |

OTHER PUBLICATIONS

Title: Flush Clamp; http://www.newmantools.com/baflush.htm Date of access: May 19, 2015.

*Primary Examiner* — Adriana Figueroa

(74) *Attorney, Agent, or Firm* — Dinsmore & Shohl LLP

(57) ABSTRACT

A truss clamp assembly includes a lower support member extending in a lateral direction, a vertical rod coupled to the lower support member and extending in a vertical direction that is transverse to the lateral direction, a first engagement portion coupled to the vertical rod and spaced apart from the lower support member in the vertical direction, and a second engagement portion coupled to the vertical rod and spaced apart from the lower support member in the vertical direction, where the second engagement portion is spaced apart from the first engagement portion in the lateral direction, such that the first engagement portion and the second engagement portion define a gap positioned between the first engagement portion and the second engagement portion in the lateral direction.

20 Claims, 4 Drawing Sheets

(56) References Cited

U.S. PATENT DOCUMENTS

| | | | | |
|---|---|---|---|---|
| 2014/0332659 | A1 | 11/2014 | Tichell Fortea | |
| 2015/0292207 | A1* | 10/2015 | Prowse | E04C 5/165 52/707 |

* cited by examiner

TRUSS CLAMP ASSEMBLIES

TECHNICAL FIELD

The present specification generally relates to truss clamp assemblies, and in particular truss clamp assemblies for supporting structural members. Methods for supporting structural members with a truss clamp assembly are also disclosed.

BACKGROUND

Manufacturing facilities may include various structural members that are coupled to one another. In one example, the structural members may include I-Beams that are coupled to one another using fasteners, such as tab bolts. The structural members may be positioned overhead to support various manufacturing equipment, such as vehicle conveyors, overhead cranes, and/or overhead hoists, and the structural members may be positioned beneath and coupled to overhead building structures, such as trusses.

The fasteners that couple the structural members together are subjected to compressive, tensile, and/or shear stresses which may cause the fasteners to break or fracture and the fasteners may be replaced. The structural members that are coupled to one another by the fasteners may be supported while the broken fasteners are removed and replaced. Conventional methods of supporting the structural members include connecting the structural members to the overhead building structures positioned above the structural members with manual hoists or chain falls. These conventional methods may require significant manipulation to correctly connect the manual hoists and chain falls to the structural members, which may result in process downtime and increased manufacturing costs.

Accordingly, alternative apparatuses and methods for supporting structural members are desired.

SUMMARY

In one embodiment, a truss clamp assembly includes a lower support member extending in a lateral direction, a vertical rod coupled to the lower support member and extending in a vertical direction that is transverse to the lateral direction, a first engagement portion coupled to the vertical rod and spaced apart from the lower support member in the vertical direction, and a second engagement portion coupled to the vertical rod and spaced apart from the lower support member in the vertical direction, where the second engagement portion is spaced apart from the first engagement portion in the lateral direction, such that the first engagement portion and the second engagement portion define a gap positioned between the first engagement portion and the second engagement portion in the lateral direction.

In another embodiment, a truss clamp assembly includes a lower support member extending in a lateral direction, a pair of vertical rods coupled to the lower support member and extending in a vertical direction, where the pair of vertical rods are spaced apart from one another in the lateral direction, a first engagement portion coupled to and positioned between the pair of vertical rods in the lateral direction, and a second engagement portion coupled to and positioned between the pair of vertical rods in the lateral direction, where the second engagement portion is spaced apart from the first engagement portion in the lateral direction, such that the first engagement portion and the second engagement portion define a gap positioned between the first engagement portion and the second engagement portion in the lateral direction.

In yet another embodiment, a method of replacing a fastener coupled to a structural member includes positioning a lower support member of a truss clamp assembly below the structural member in a vertical direction, engaging a flange of an overhead building structure positioned above the structural member in the vertical direction with a first engagement portion of the truss clamp assembly, engaging the flange of the overhead building structure with a second engagement portion of the truss clamp assembly, where the second engagement portion is spaced apart from the first engagement portion in a lateral direction that is transverse to the vertical direction, and moving the lower support member of the truss clamp assembly toward the structural member in the vertical direction.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Truss clamp assemblies according to the present disclosure may selectively couple a structural member to an overhead building structure. The truss clamp assemblies include engagement portions that are shaped to accommodate features of the overhead building structure, which may assist in providing a stable connection between the structural member and the overhead building structure. These and other embodiments will be described in more detail below in reference to the appended drawings.

As used herein, the term "longitudinal direction" refers to the length-wise direction of the truss clamp assembly (i.e., in the +/−X-direction as depicted). The term "lateral direction" refers to the width-wise direction of the truss clamp assembly (i.e., in the +/−Y-direction as depicted), and is transverse to the axial direction. The term "vertical direction" refers to the upward-downward direction of the truss clamp assembly (i.e., in the +/−Z-direction as depicted), and is transverse to the longitudinal direction and the lateral direction.

Figure 1:
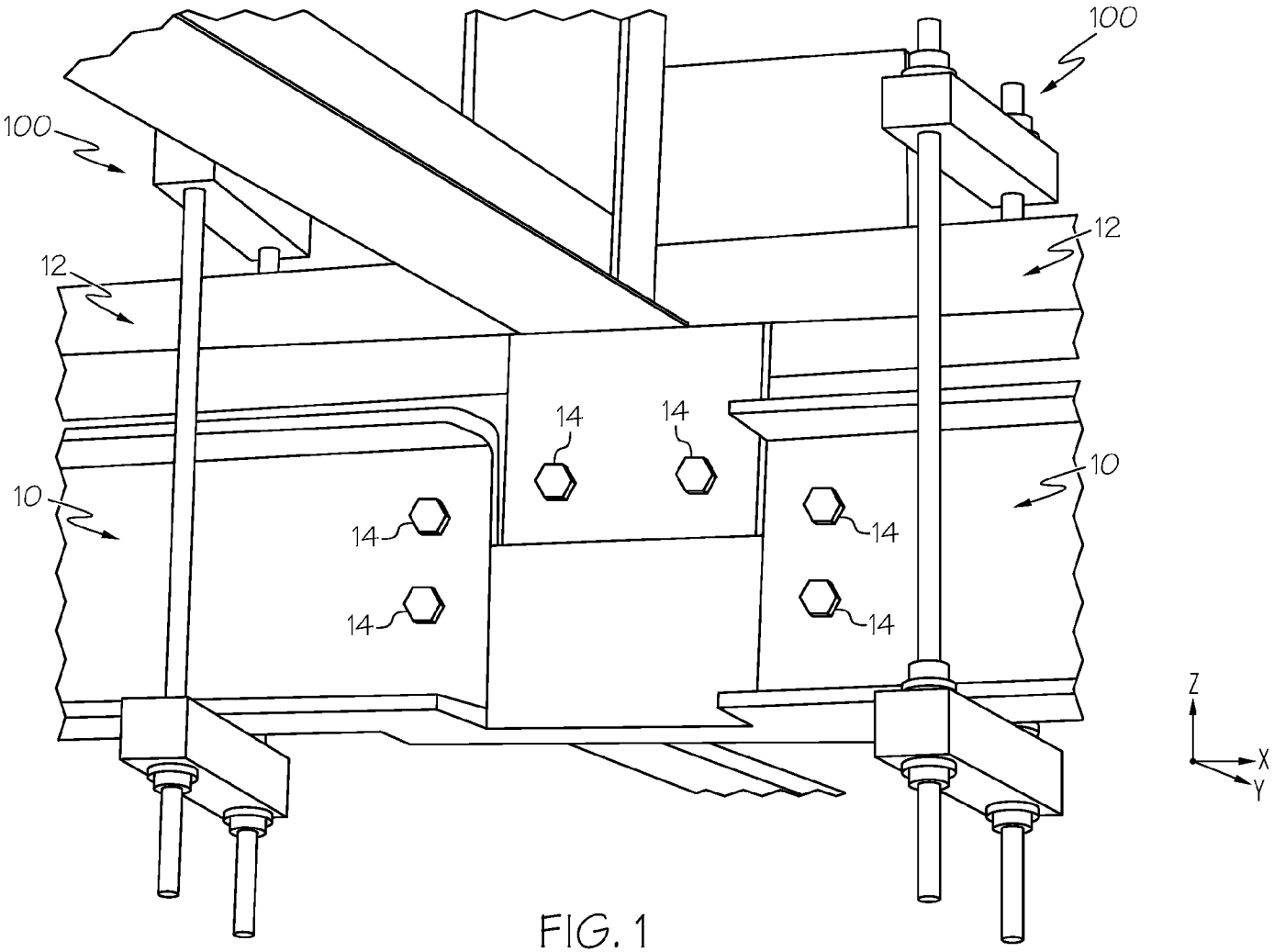
FIG. 1 schematically depicts a pair of truss clamp assemblies supporting structural members according to one or more embodiments shown and described herein.

Referring initially to FIG. 1, a perspective view of a pair of structural members 10 is depicted. The structural members 10 may include various structural support beams, such as may be positioned overhead in a manufacturing facility. The structural members 10 may support and be coupled to various manufacturing equipment, such as conveyors, overhead cranes, overhead hoists, and the like. In the embodiment depicted in FIG. 1, the structural members 10 include I-beams, however, it should be understood that the structural members 10 may include structural support beams having any suitable cross-section, including, but not limited to, T-beams, H-beams, rectangular beams, and the like.

The structural members 10 may be coupled to and supported by overhead building structures 12. The overhead building structures 12 may include various building structures, such as trusses, positioned above the structural members 10. In embodiments, individual structural members 10 may be coupled to one another through a fastener or fasteners 14. The fasteners 14 may include any one or combination of a variety of mechanical fasteners, such as bolts, pins, and the like. In operation, the fasteners 14 may be subjected to tensile, compressive, and/or shear stresses, which over time, may weaken or fracture the fasteners 14. Weakened or fractured fasteners 14 may be removed and replaced with new fasteners 14, and/or the fasteners 14 may be removed and replaced prior to fracture of the fasteners 14 as part of a preventative maintenance program.

The structural members 10 may be supported separately from the fasteners 14 to remove stress from the fasteners 14 such that the fasteners 14 may be removed and replaced. To support the structural members 10, the structural members may be selectively coupled to the overhead building structures 12 with one or more truss clamp assemblies 100. The truss clamp assemblies 100 temporarily support the structural members 10 in a removable fashion while the fasteners 14 are removed and replaced. Once the fasteners 14 have been removed and replaced with new fasteners 14, the truss clamp assemblies 100 may be removed from the structural members 10 and the overhead building structures 12, as will be described in greater detail herein.

Figure 2:
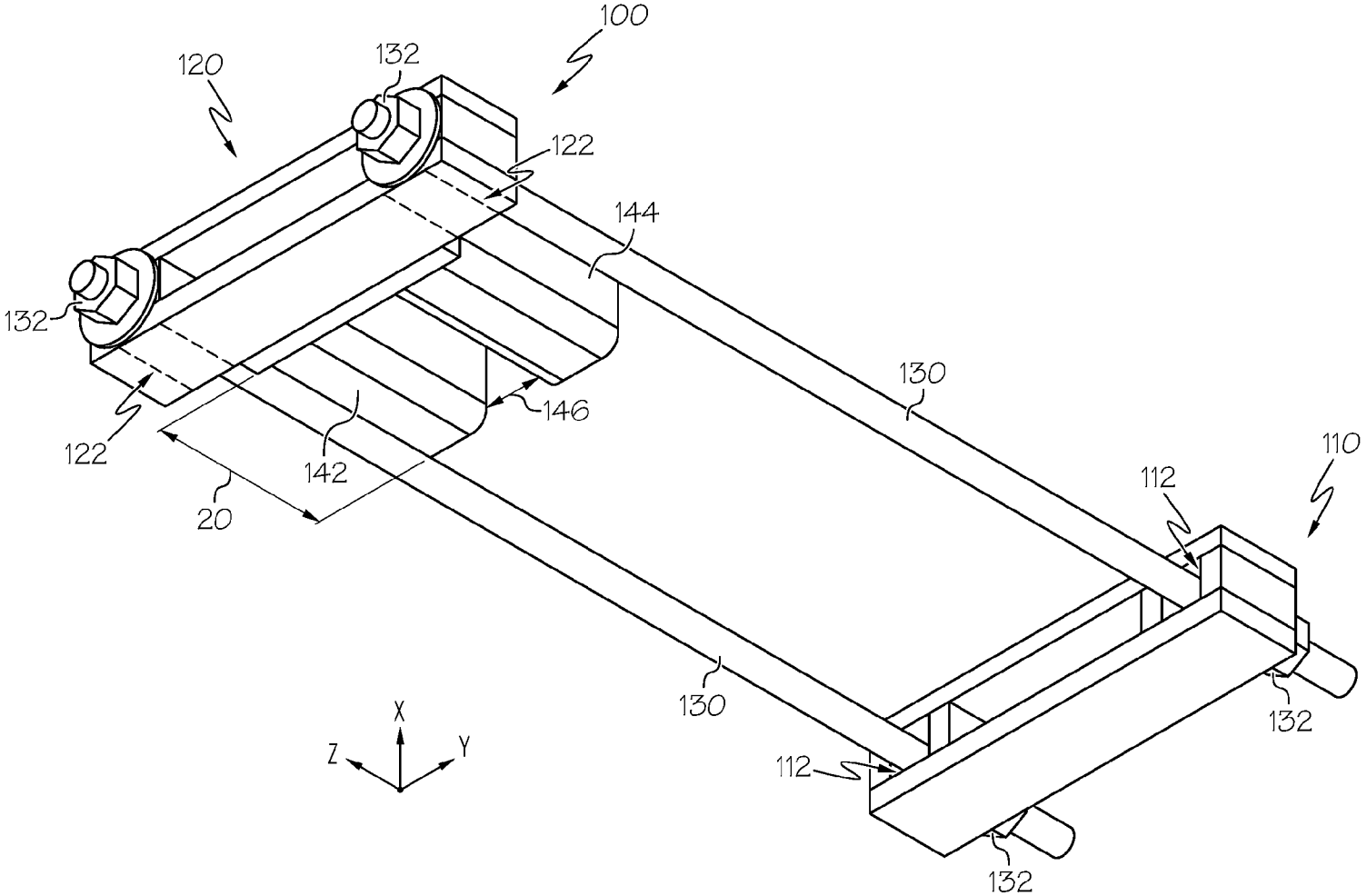
FIG. 2 schematically depicts a perspective view of one of the truss clamp assemblies of FIG. 1 according to one or more embodiments shown and described herein.
Figure 3:
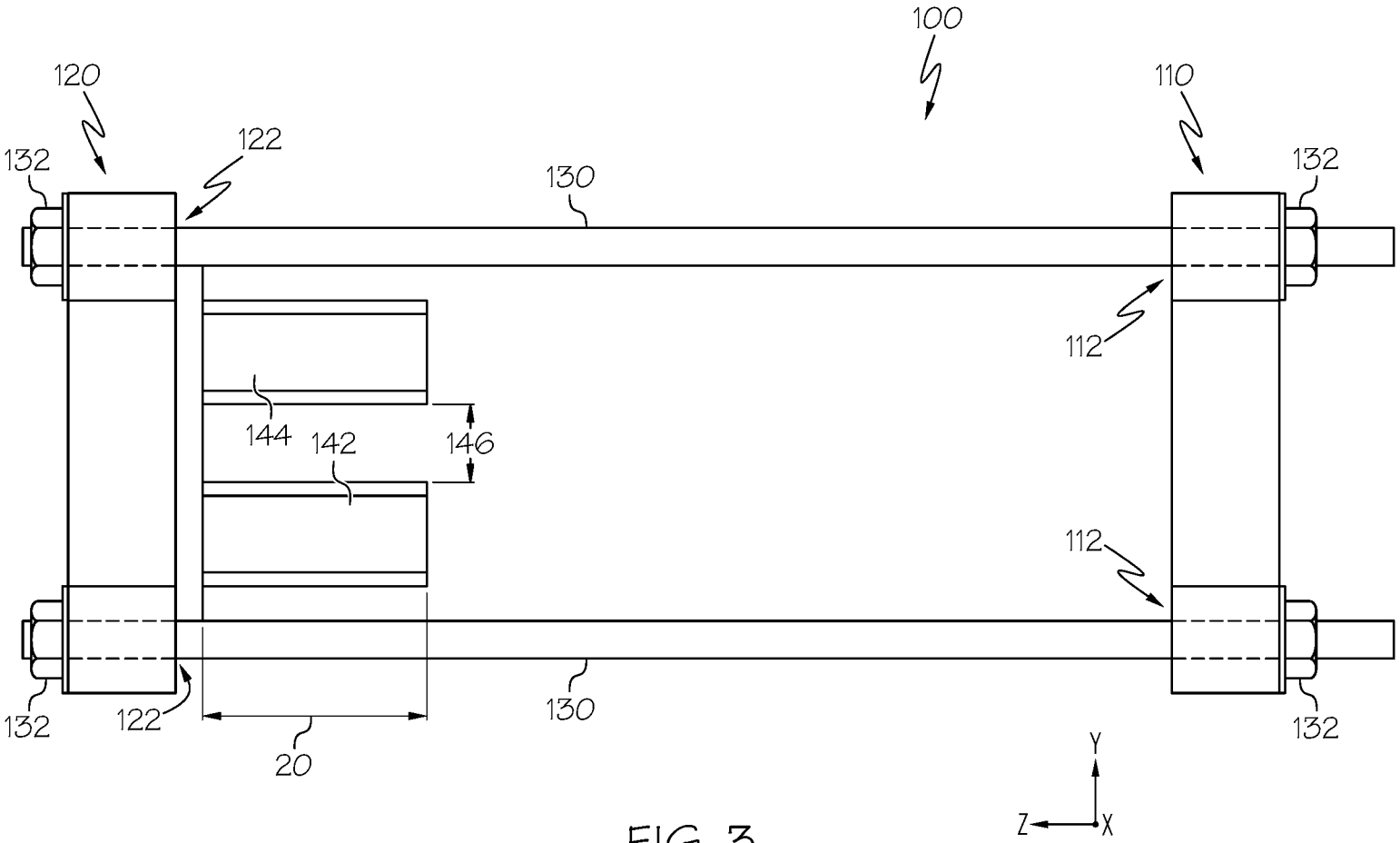
FIG. 3 schematically depicts a front view of the truss clamp assembly of FIG. 2 according to one or more embodiments shown and described herein.

Referring collectively to FIGS. 2 and 3, a perspective view and a front view of the truss clamp assembly 100 are depicted, respectively. In embodiments, the truss clamp assembly 100 includes a lower support member 110, an upper support member 120, a first engagement portion 142 and a second engagement portion 144, and a vertical rod 130 coupled to the lower support member 110 and the upper support member 120. In the embodiment depicted in FIGS. 2 and 3, the truss clamp assembly 100 includes a pair of vertical rods 130 that are spaced apart from one another in the lateral direction.

The lower support member 110 is coupled to and extends between the pair of vertical rods 130 in the lateral direction. In the embodiment depicted in FIGS. 2 and 3, the lower support member 110 defines a pair of apertures 112 that extend through the lower support member 110 in the vertical direction. Each of the pair of vertical rods 130 may be inserted in and extend through the pair of apertures 112 of the lower support member 110. The pair of apertures 112 may restrict movement of the lower support member 110 with respect to the pair of vertical rods 130 in the lateral direction and the longitudinal direction, but may allow the lower support member 110 to move with respect to the vertical rods 130 in the vertical direction along lengths of the vertical rods 130 relative to the upper support member 120. In embodiments, the lower support member 110 may be formed from any material or combination of materials including, for example and without limitation, metals, composites, and the like, and may be formed by any suitable method or combination of methods such as stamping, forging, machining, and the like.

The upper support member 120 is coupled to and extends between the pair of pair of vertical rods 130 in the lateral direction. The upper support member 120 is spaced apart from the lower support member 110 in the vertical direction. In the embodiment depicted in FIGS. 2 and 3, the upper support member 120 defines a pair of apertures 122 that extend through the upper support member 120 in the vertical direction. Each of the pair of vertical rods 130 may be inserted in and extend through the pair of apertures 122 in the upper support member 120. The pair of apertures 122 may restrict movement of the upper support member 120 with respect to the pair of vertical rods 130 in the lateral direction and the longitudinal direction, but may allow the upper support member 120 to move with respect to the vertical rods 130 in the vertical direction along lengths of the vertical rods 130 relative to the lower support member 110. In embodiments, the upper support member 120 may be formed from any material or combination of materials including, for example and without limitation, metals, composites, and the like, and may be formed by any suitable method or combination of methods such as stamping, forging, machining, and the like.

The first engagement portion 142 and the second engagement portion 144 are coupled to and extend downward from the upper support member 120 in the vertical direction. In embodiments, the first engagement portion 142 and the second engagement portion 144 are positioned on the upper support member 120 such that the first engagement portion 142 and the second engagement portion 144 are positioned between the pair of vertical rods 130 in the lateral direction. The first engagement portion 142 and the second engagement portion 144 may be coupled to the upper support member 120 through any one of a variety of connection techniques, including, but not limited to, welding, brazing, connection with structural adhesives, and connection with mechanical fasteners. Alternatively, in some embodiments, the first engagement portion 142 and the second engagement portion 144 may be integrally formed with the upper support member 120. The first engagement portion 142 and the second engagement portion 144 may be formed from any material or combination of materials including, for example and without limitation, metals, composites, and the like, and may be formed by any suitable method or combination of methods such as stamping, forging, machining, and the like.

As the first engagement portion 142 and the second engagement portion 144 are coupled to the upper support member 120, the first engagement portion 142 and the second engagement portion 144 are indirectly coupled to the pair of vertical rods 130 through the upper support member 120. The first engagement portion 142 and the second engagement portion 144 are spaced apart from one another in the lateral direction, such that the first engagement portion 142 and the second engagement portion 144 define a gap 146 positioned between the first engagement portion 142 and the second engagement portion 144 in the lateral direction. The gap 146 between the first engagement portion 142 and the second engagement portion 144 may accommodate features of the overhead building structure 12 (FIG. 1), as will be described in greater detail herein.

In embodiments, the first engagement portion 142 and the second engagement portion 144 have a height 20 evaluated in the vertical direction. The gap 146 between the first engagement portion 142 and the second engagement portion 144 may be co-extensive with the first engagement portion 142 and the second engagement portion 144, such that the gap 146 similarly has the height 20 evaluated in the vertical direction. The height 20 of the first engagement portion 142 and the second engagement portion 144 may be selected to assist the first engagement portion 142 and the second engagement portion 144 in accommodating features of the overhead building structure 12 (FIG. 1).

In embodiments, fasteners 132 are coupled to the pair of pair of vertical rods 130. Individual fasteners 132 are positioned on the pair of pair of vertical rods 130 to restrict movement of the upper support member 120 and the lower support member 110 with respect to the pair of vertical rods 130 in the vertical direction away from each other. In the embodiment depicted in FIGS. 2 and 3, fasteners 132 are positioned above the upper support member 120 in the vertical direction such that upward movement (i.e., in the +z-direction) of the upper support member 120 with respect to the pair of vertical rods 130 is restricted. Individual fasteners 132 are positioned below the lower support member 110 in the vertical direction such that downward movement (i.e., in the −z-direction) of the lower support member 110 with respect to the pair of vertical rods 130 is restricted. The fasteners 132 may include mechanical fasteners, including, but not limited to, nuts, washers, lock washers, and the like.

In embodiments, the fasteners 132 are selectively coupled to the pair of vertical rods 130 such that the fasteners 132 may be coupled to and removed from the pair of vertical rods 130. Additionally, the fasteners 132 are adjustable with respect to the pair of vertical rods 130 in the vertical direction. For example, in some embodiments, the pair of vertical rods 130 and the fasteners 132 may include threading, and the fasteners 132 may be threaded onto the pair of vertical rods 130. By moving the fasteners 132 on the threading of the pair of vertical rods 130, the position of the fasteners 132 on the pair of vertical rods 130 may be adjusted in the vertical direction. By adjusting the position of the fasteners 132 on the pair of vertical rods 130, the positions of the lower support member 110 and the upper support member 120 may be adjusted in the vertical direction with respect to the vertical rods 130 and each other, such that the lower support member 110 and the upper support member 120 are movably coupled to the pair of vertical rods 130 in the vertical direction. As the first engagement portion 142 and the second engagement portion 144 are coupled to the upper support member 120, the first engagement portion 142 and the second engagement portion 144 are movably coupled to the pair of vertical rods 130 through the upper support member 120, and the position of the first engagement portion 142 and the second engagement portion 144 with respect to the pair of vertical rods 130 is adjustable in the vertical direction.

Methods of replacing fasteners 14 (FIG. 1) that are coupled to the structural members 10 (FIG. 1) using the truss clamp assembly 100 will now be described.

Figure 4:
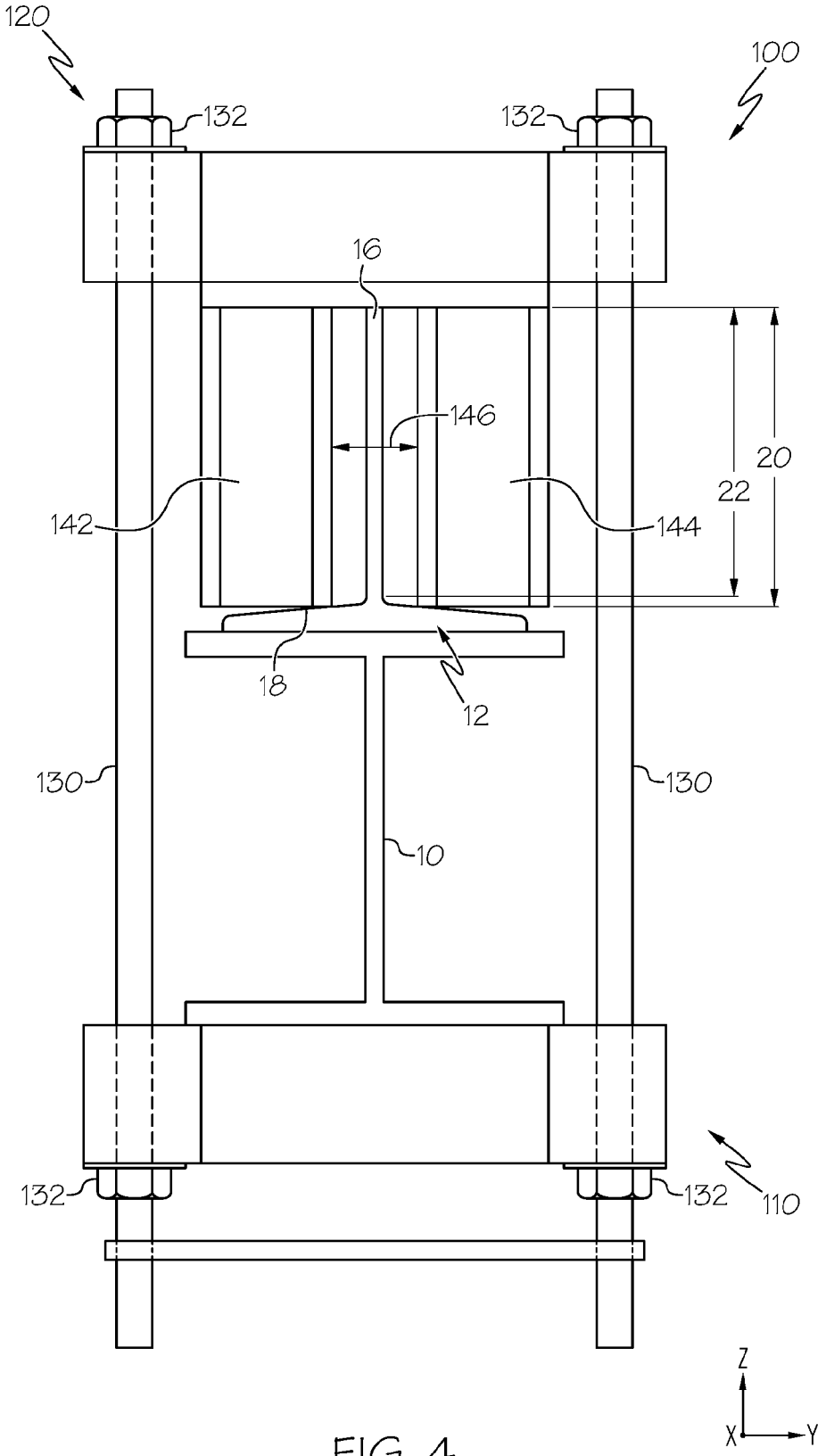
FIG. 4 schematically depicts a front view of the truss clamp assembly of FIG. 3 engaged with a structural member and an overhead building structure according to one or more embodiments shown and described herein.

Referring to FIG. 4, a truss clamp assembly 100 is depicted selectively coupling a structural member 10 to an overhead building structure 12. To selectively couple the structural member 10 to the overhead building structure 12, the lower support member 110 of the truss clamp assembly 100 is positioned below the structural member 10 in the vertical direction. The upper support member 120 of the truss clamp assembly 100 is positioned above the overhead building structure 12 in the vertical direction, and the pair of vertical rods 130 extends between the structural member 10 and the overhead building structure 12 in the vertical direction.

In the embodiment depicted in FIG. 4, the overhead building structure 12 includes a flange 18 that extends in the lateral direction and a web 16 that extends upward from the flange 18 in the vertical direction. The first engagement portion 142 and the second engagement portion 144 are engaged with the flange 18 of the overhead building structure 12, and the web 16 of the overhead building structure 12 may be positioned within the gap 146 between the first engagement portion 142 and the second engagement portion 144.

In embodiments, the gap 146 is shaped to accommodate the web 16 of the overhead building structure 12 when the first engagement portion 142 and the second engagement portion 144 are engaged with the flange 16. In particular, the height 20 of the first engagement portion 142, the second engagement portion 144, and the gap 146 is greater than a height 22 of the web 16 of the overhead building structure 12. As the height 20 of the gap 146 is greater than the height 22 of the web 16, the upper support member 120 may not contact the web 16 of the overhead building structure 12. Instead, when the truss clamp assembly 100 is selectively coupled to the overhead building structure 12, the weight of the truss clamp assembly 100 and the structural member 10 may be primarily directed into the flange 18 of the overhead building structure 12 through the first engagement portion 142 and the second engagement portion 144. By directing the weight of the truss clamp assembly 100 and the structural member 10 into the flange 18 of the overhead building structure 12, the stability of the truss clamp assembly 100 may be increased as compared to if the weight of the truss clamp assembly 100 is directed into the web 16 of the overhead building structure 12. In particular, in the embodiment depicted in FIG. 4, the overhead building structure 12 includes a T-beam including a flange 18 and a web 16 that extends upward from the flange 18, where the flange 18 includes a wider cross-section evaluated in the lateral direction than the web 16. By engaging the flange 18 of the overhead building structure 12, the first engagement portion 142 and the second engagement portion 144 may restrict rotation of the truss clamp assembly about the longitudinal direction.

With the first engagement portion 142 and the second engagement portion 144 engaged with the flange 18 of the overhead building structure 12, the lower support member 110 may be moved upward toward the structural member 10 in the vertical direction. In particular, the lower support member 110 may be moved upward in the vertical direction by adjusting the position of the fasteners 132 positioned below the lower support member 110. The lower support member 110 may be moved upward until the lower support member 110 contacts and engages the structural member 10.

With the first engagement portion 142 and the second engagement portion 144 engaging the overhead building structure 12 and the lower support member 110 engaging the structural member 10, the position of the structural member 10 with respect to the overhead building structure 12 may be fixed in the vertical direction by the truss clamp assembly 100.

The lower support member 110 may continue to be drawn upward toward in the vertical direction toward the overhead building structure 12 to relieve stress on the fasteners 14 (FIG. 1) that couple individual structural members 10 to one another. By relieving stress on the fasteners 14 (FIG. 1), the fasteners 14 (FIG. 1) may be removed and replaced with new fasteners. Once the fasteners 14 (FIG. 1) have been replaced, the lower support member 110 may be lowered with respect to the structural member 10, and the truss clamp assembly 100 may be removed from the structural member 10 and the overhead building structure 12.

It should now be understood that truss clamp assemblies according to the present disclosure may selectively couple a structural member to an overhead building structure. The truss clamp assemblies include engagement portions that are shaped to accommodate features of the overhead building structure, which may assist in providing a stable connection between the structural member and the overhead building structure.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A truss clamp assembly comprising:

a lower support member extending in a lateral direction;

a first vertical rod coupled to the lower support member and extending in a vertical direction that is transverse to the lateral direction;

a second vertical rod coupled to the lower support member and extending in the vertical direction that is transverse to the lateral direction, the second vertical rod being spaced apart from the first vertical rod in the lateral direction;

wherein the lower support member extends from the first vertical rod to the second vertical rod;

a first engagement portion located entirely between the first vertical rod and the second vertical rod and spaced apart from the lower support member in the vertical direction; and a second engagement portion located entirely between the first vertical rod and the second vertical rod and spaced apart from the lower support member in the vertical direction, wherein the second engagement portion is spaced apart from the first engagement portion in the lateral direction, such that the first engagement portion and the second engagement portion define a gap positioned between the first engagement portion and the second engagement portion in the lateral direction, the gap having opposite open ends facing in a longitudinal direction that is transverse to the lateral direction, the gap configured to receive a web of an overhead building structure.

2. The truss clamp assembly of claim 1, wherein the first engagement portion and the second engagement portion are movably coupled indirectly to the first vertical rod and the second vertical rod, such that a position of the first engagement portion and the second engagement portion with respect to the vertical rod is adjustable in the vertical direction.

3. The truss clamp assembly of claim 1, further comprising an upper support member coupled to the first vertical rod, the second vertical rod, the first engagement portion, and the second engagement portion, wherein the first engagement portion and the second engagement portion are coupled to the first vertical rod and the second vertical rod through the upper support member.

4. The truss clamp assembly of claim 3, wherein the upper support member is movably coupled to the first vertical rod and the second vertical rod, such that a position of the upper support member with respect to the first vertical rod and the second vertical rod is adjustable in the vertical direction.

5. The truss clamp assembly of claim 3, wherein the first engagement portion and the second engagement portion extend downward from the upper support member in the vertical direction.

6. The truss clamp assembly of claim 1, wherein the lower support member is movably coupled to the first vertical rod and the second vertical rod, such that a position of the lower support member with respect to the first vertical rod and the second is adjustable in the vertical direction.

7. A truss clamp assembly comprising: a lower support member extending in a lateral direction;

a pair of vertical rods coupled to the lower support member and extending in a vertical direction, wherein the pair of vertical rods are spaced apart from one another in the lateral direction;

wherein the lower support member extends from the first vertical rod to the second vertical rod;

a first engagement portion coupled to and positioned entirely between the pair of vertical rods in the lateral direction; and a second engagement portion coupled to and positioned entirely between the pair of vertical rods in the lateral direction, wherein the second engagement portion is spaced apart from the first engagement portion in the lateral direction, such that the first engagement portion and the second engagement portion define a gap positioned between the first engagement portion and the second engagement portion in the lateral direction, the gap having opposite open ends facing in a longitudinal direction that is transverse to the lateral direction, the gap configured to receive a web of an overhead building structure.

8. The truss clamp assembly of claim 7, wherein the first engagement portion and the second engagement portion are movably coupled indirectly to the pair of vertical rods, such that a position of the first engagement portion and the second engagement portion with respect to the pair of vertical rods is adjustable in the vertical direction.

9. The truss clamp assembly of claim 7, further comprising an upper support member coupled to the pair of vertical rods, wherein the upper support member extends in the lateral direction between the pair of vertical rods.

10. The truss clamp assembly of claim 9, wherein the upper support member is spaced apart from the lower support member in the vertical direction.

11. The truss clamp assembly of claim 9, wherein the upper support member is movably coupled to the pair of vertical rods, such that a position of the upper support member with respect to the pair of vertical rods is adjustable in the vertical direction.

12. The truss clamp assembly of claim 9, wherein the upper support member is coupled to the first engagement portion and the second engagement portion, wherein the first engagement portion and the second engagement portion are coupled to the pair of vertical rods through the upper support member.

13. The truss clamp assembly of claim 12, wherein the first engagement portion and the second engagement portion extend downward from the upper support member in the vertical direction.

14. The truss clamp assembly of claim 13, wherein the first engagement portion and the second engagement portion are configured to have a height evaluated in the vertical direction that is greater than a height of a web of an overhead building structure.

15. The truss clamp assembly of claim 7, wherein the gap is configured to have a height evaluated in the vertical direction that is greater than a height of a web of an overhead building structure.

16. The truss clamp assembly of claim 7, wherein the lower support member is movably coupled to the pair of vertical rods, such that a position of the lower support member with respect to the pair of vertical rods is adjustable in the vertical direction.

17. A method for replacing a fastener coupled to a structural member, the method comprising:

positioning a lower support member of a truss clamp assembly below the structural member in a vertical direction, the lower support member extending in a lateral direction, wherein the truss clamp assembly further comprises:

a pair of vertical rods coupled to the lower support member and extending in a vertical direction, wherein the pair of vertical rods are spaced apart from one another in the lateral direction, the lower support member extending from one of the pair of vertical rods to another of the pair of vertical rods;

a first engagement portion coupled to and positioned entirely between the pair of vertical rods in the lateral direction; and a second engagement portion coupled to and positioned entirely between the pair of vertical rods in the lateral direction, wherein the second engagement portion is spaced apart from the first engagement portion in the lateral direction, such that the first engagement portion and the second engagement portion define a gap positioned between the first engagement portion and the second engagement portion in the lateral direction, the gap having opposite open ends facing in a longitudinal direction that is transverse to the lateral direction, the gap configured to receive a web of an overhead building structure;

engaging a flange of an overhead building structure positioned above the structural member in the vertical direction with the first engagement portion of the truss clamp assembly;

engaging the flange of the overhead building structure with the second engagement portion of the truss clamp assembly; and moving the lower support member of the truss clamp assembly toward the structural member in the vertical direction.

18. The method of claim 17, further comprising engaging the lower support member of the truss clamp assembly with the structural member, such that a position of the structural member with respect to the overhead building structure is fixed in the vertical direction.

19. The method of claim 18, further comprising removing the fastener from the structural member.

20. The method of claim 17, wherein the first engagement portion and the second engagement portion define the gap positioned between the first engagement portion and the second engagement portion in the lateral direction, wherein a height of the gap evaluated in the vertical direction is greater than a height of a web of the overhead building structure.

* * * * *